United States Patent [19]

Levy-Joseph

[11] Patent Number: 4,472,909

[45] Date of Patent: Sep. 25, 1984

[54] SAFETY TURNSTILE HAVING THE PRIMARY FUNCTION OF CONTROLLING THE ENTRANCE OF STORES

[75] Inventor: Marc Levy-Joseph, Strasbourg, France

[73] Assignee: Ateliers Reunis, Schiltigheim, France

[21] Appl. No.: 484,417

[22] Filed: Apr. 12, 1983

[30] Foreign Application Priority Data

May 21, 1982 [FR] France ..... 82 08884

[51] Int. Cl.[3] ..... E06B 11/08

[52] U.S. Cl. ..... 49/46

[58] Field of Search ..... 49/46, 47, 35

[56] References Cited

U.S. PATENT DOCUMENTS

| | | | |
|---|---|---|---|
| 987,445 | 3/1911 | Driver | 49/46 X |
| 1,007,927 | 11/1911 | Davis | 49/46 X |
| 4,203,686 | 5/1980 | Bowman | 49/35 X |

*Primary Examiner*—Kenneth Downey

*Attorney, Agent, or Firm*—Young & Thompson

[57] ABSTRACT

A safety turnstile for permitting entry of the public in one direction and preventing exit of the public in the opposite direction comprises a rotary head which can be removed from the turnstile support post in a rapid and simple manner. The rotary head is tightly fitted on the central pivot which is secured to the top end of the turnstile post. Provision is made for an annular member fixed beneath the base of the head and for a ring provided with projecting lugs which are capable of resilient snap-action engagement within retaining recesses formed in the internal periphery of the annular member. When the lugs are inserted in the annular member, the ring is resiliently coupled with the head which can be released from the post only as a result of an upward thrust followed by a rotational displacement through an angle of 45 degrees.

4 Claims, 6 Drawing Figures

SAFETY TURNSTILE HAVING THE PRIMARY FUNCTION OF CONTROLLING THE ENTRANCE OF STORES

This invention relates to a safety turnstile through which persons are permitted to pass in one direction and prevented from passing in the opposite direction.

Turnstiles of this type are commonly installed at the entrance of stores, stadiums or other public places for guiding the influx of visitors.

Said turnstile comprises a head to which are attached radially extending arms, said head being rotatably mounted on a pivot placed on the top end of a supporting post.

For safety reasons and in the event of panic, it must be made possible to provide an emergency exit through the turnstile in the normally forbidden direction in order to permit evacuation of the premises. In consequence, the rotary head of the turnstile must permit relatively easy removal.

In order to satisfy this requirement, the turnstile is provided in one known design with a ring which can be detachably secured to the lower end of the rotary head and around the top end of the turnstile post in order to maintain the head on the pivot which projects in an overhung position above the top end of the post. Said ring is provided with a threaded shouldered portion and tne bottom of said ring may thus be secured to the lower portion of the rotary cylindrical head in order to prevent detachment of this latter. When it is desired to release the rotary head, it is necessary to unscrew said ring which is thus disengaged from the rotary head and releases this latter from its pivot.

The disadvantage of this design arises from the fact that screwing and unscrewing usually make it necessary to carry out several complete revolutions of the ring. This operation therefore necessarily takes a longer time than would be desirable in order to disengage the rotary head in the event of panic and a sudden rush of a crowd towards the exit which is controlled by the turnstile.

In accordance with the invention, an annular member is secured to the lower end of the rotary head in such a manner as to provide an annular passage between on the one hand the top of the turnstile post and on the other hand the annular member and the base of the head. In said annular member are formed slots in which corresponding projecting lugs of the ring are capable of resilient snap-action engagement, with the result that said ring can take up two angular positions within the annular member: a first position in which the ring is disengaged from the annular member and consequently from the rotary head which can be detached from the turnstile post and a second position in which the ring is rigidly fixed to the annular member and retains the rotary head on the pivot and the post, these two positions being separated by a predetermined angular interval.

By way of example, said angular interval can be 45 degrees. Thus in order to change from the position of engagement of the ring on the annular member to its position of release so as to permit disengagement of the rotary head of the turnstile, it is only necessary to rotate the ring through an angle of 45 degrees. The operation which accordingly consists in releasing the rotary head with respect to the pivot can therefore be carried out much more rapidly than in the case of the design of the prior art which consisted of a threaded ring.

In one embodiment of the invention, the ring is provided with a projecting internal annular collar which is coaxial with the turnstile post and can be introduced within the annular passage between the rotary head and the post. Said annular collar is provided with at least two lugs adapted to engage within two associated slots formed in the annular member. At least two recesses are arranged in said annular collar at predetermined angular intervals such as 45 degrees with respect to the corresponding slots in order to receive the lugs of the ring after a corresponding rotation of said ring. Resilient snap-action engagement means are provided for locking the lugs within the recesses and subsequently for coupling the ring with the annular member and rotary head in interlocked relation.

In consequence, the snap-action engagement means usually serve to maintain the rotary head in a position in which it is secured both to the pivot and to the turnstile post but are so arranged as to be capable of withdrawing under an oppositely-acting force exerted on the ring, with the result that these elements can be displaced in a relative movement of rotation through an angle of 45 degrees until the head-release position is reached.

Other features of the invention will be more apparent upon consideration of tne following description and accompanying drainges, wherein.

Figure 1:
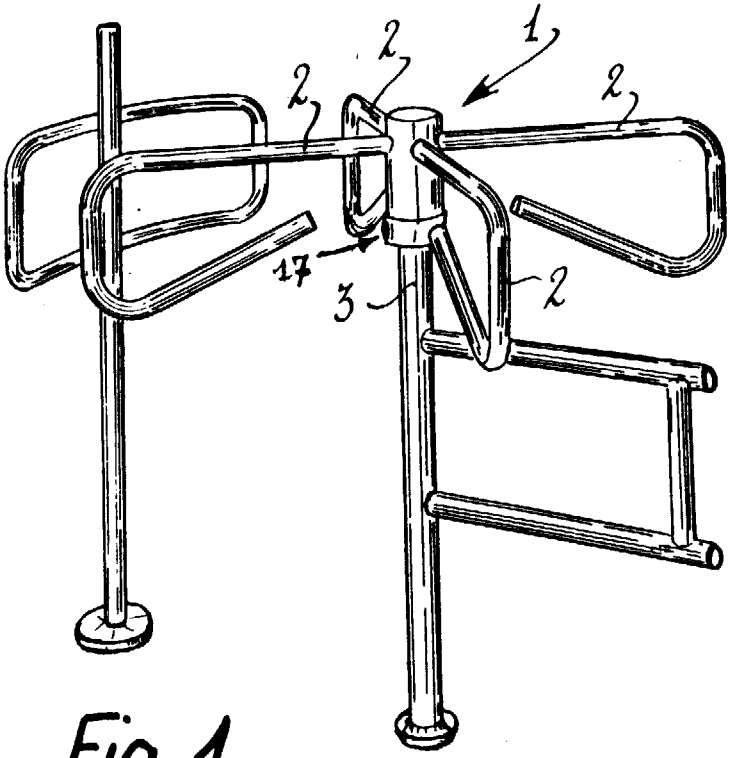
FIG. 1 is a view in perspective of a safety turnstile of the type contemplated by the invention with a view to placing the turnstile at the entrance of a store or any other location in which it is desired to guide the influx of visitors while normally preventing any exit through the same turnstile.

There is shown in FIG. 1 a safety turnstile which can be installed at the entrance of a store, a stadium or other places for guiding the influx of visitors.

Said turnstile comprises a rotary head 1 having a cylindrical shape to which are attached four radially extending arms 2 disposed at right angles. Said head is rotatably mounted on a vertical supporting post 3 by means of a pivot (not shown in FIG. 1).

In a manner known per se, the rotary head 1 is so arranged as to permit admission of customers or visitors in one direction of rotation and to prevent any person from leaving in the opposite direction since rotational displacement of the head 1 and of the arms 2 is automatically prevented in the direction of exit.

Figure 2:
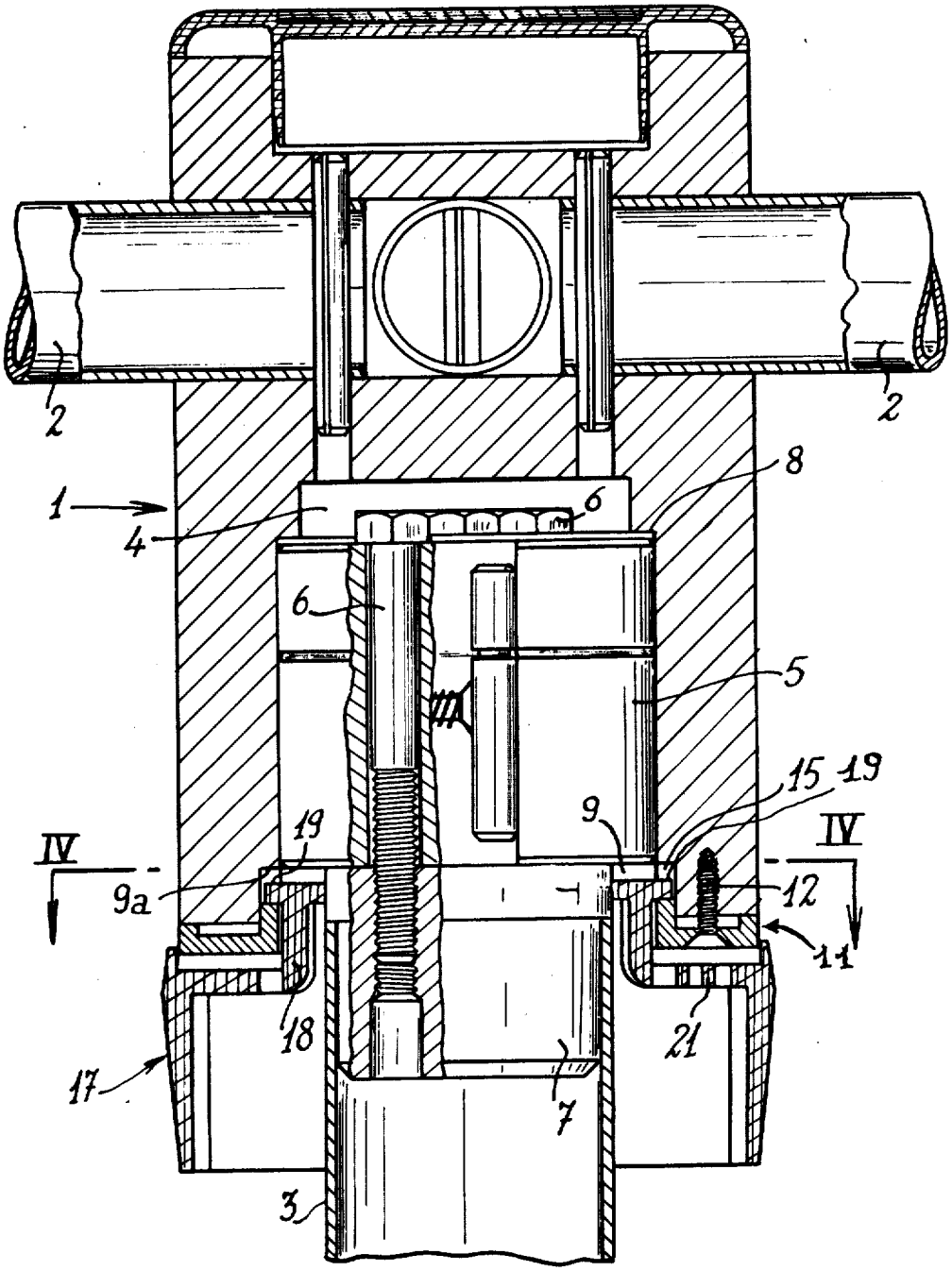
FIG. 2 is a full-scale axial view in half-section and half-elevation showing the constituent elements of the turnstile in accordance with the invention, namely the rotary head, the pivot, the ring and the annular member.

The arms 2 are attached to the head 1 in the known manner which is illustrated in FIG. 2. The cylindrical head 1 is provided with an internal cavity 4 of generally cylindrical shape, a corresponding cylindrical pivot being positioned within said cavity. Said pivot 5 is intended to bear on the top end of the vertical post 3 and is attached to this latter by means of a series of screws 6 which therefore pass through the pivot 5 and engage within a sleeve 7, said sleeve being tightly fitted within the top end of the post 3 and rigidly fixed to this latter.

The other portion of the cavity 4 has an annular shoulder 8 against which the pivot 5 is abuttingly applied. Furthermore, the pivot 5 has a diameter which is larger than that of the turnstile post 3 and is therefore located in an overhung position above this latter as clearly shown in FIG. 2. The lower portion of the rotary head 1 extends downwards to a point located below the base of the pivot 5 and therefore delimits an annular passage 9 with said pivot and the top of the post 3.

An annular member 11 is attached to the annular base of the head 1 so as to leave a free space constituting the annular passage 9. Attachment of the annular member to the head can be carried out by any suitable means such as screws 12. The annular member 11 has a projecting internal annular collar 13 which is coaxial with the post 3 and which is intended to be introduced within the annular passage 9. In more exact terms, said annular collar is adapted to fit within an annular recess 9*a* formed in the internal periphery of the base of the rotary head 1 (as shown in FIG. 2). The internal collar 13 is provided with two slots 14 in diametrically opposite relation and extending to the full height of said annular collar. Said collar is further provided with two recesses 15 which are also in diametrically opposite relation, which are each located at an angular interval of 45 degrees with respect to the contiguous slot 14, and which extend over only part of the height of the annular collar 13. The recesses 15 are separated from the slots 14 by two stepped or square-topped projecting portions 16.

The turnstile further comprises a ring 17 having an internal diameter which is substantially equal to that of the post 3 in order to be tightly fitted over this latter. The ring 17 has an upwardly projecting internal annular collar 18 which is coaxial with the post 3 and the diameter of which is substantially smaller than that of the annular collar 13 in order to be capable of engagement within the annular space 9 reserved between the annular collar 13 and the top of the post 3. The collar 18 is provided with two diametrically opposite lugs 19 which extend radially outwards and are adapted to engage within the two corresponding slots 14 when the annular collar 18 is slidably displaced within the ring 11, the lugs 19 being placed so as to correspond to the slots 14. In this relative position of the ring 17 and of the annular member 11, these two members are not rigidly coupled together and the head 1 can consequently be removed from the top of the post 3 without any difficulty.

Starting from this position, if the ring 17 is now rotated in such a manner as to ensure that the lugs 19 slide over the stepped projecting portions 16, said lugs 19 engage within the recesses 15 after a movement of rotation through an angle of 45 degrees with respect to the annular member 11. By reason of the fact that the recesses 15 extend to only part of the full height of the annular member 11, said member is rigidly fixed in this position of the lugs 19 to the ring 17 which consequently fixes the rotary head 1 on the turnstile post 3.

Figure 3:
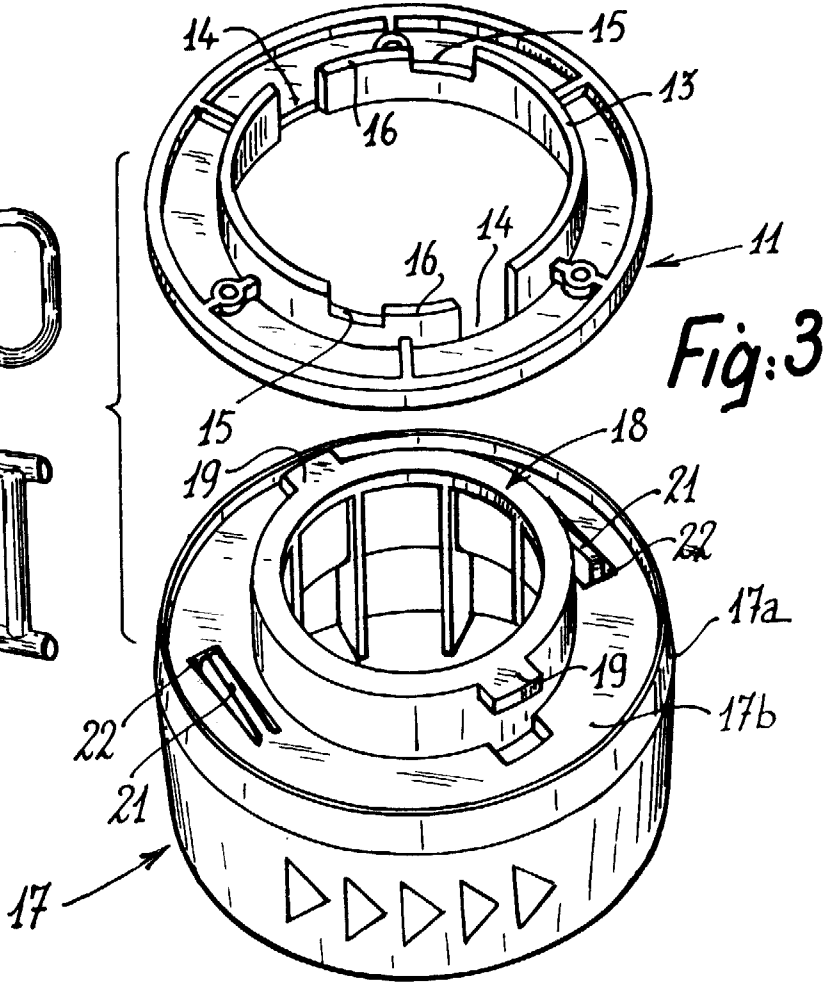
FIG. 3 is an exploded view in perspective showing the ring and the associated annular member.
Figure 6:
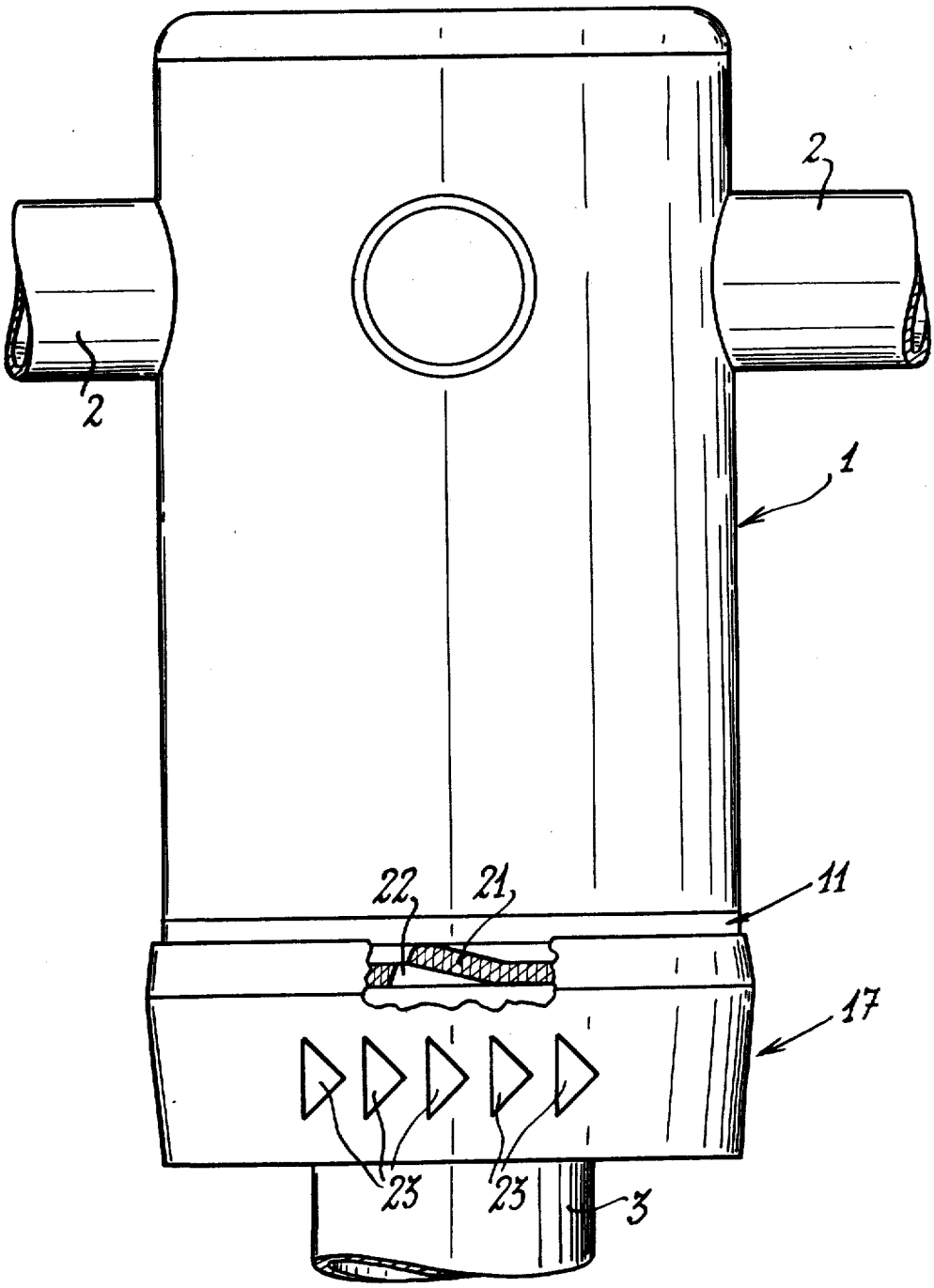
FIG. 6 is a fragmentary view in elevation showing the turnstile of FIGS. 2 to 5 and illustrating one embodiment of the resilient snap-action means whereby the ring engages in the annular member.

The invention also provides resilient snap-action means for locking the ring 17 on the annular member 11 when the lugs 19 are engaged within the recesses 15. In the example of construction herein described, said means consist of two resilient members 21 formed by two diametrically opposite tongues on the body 17*a* of the ring 17 and more precisely within the annular zone 17*b* which surrounds the annular collar 18 (as shown in FIGS. 3 and 6). The tongues 21 just mentioned can be formed in one piece with the remainder of the ring 17 at the moment of molding of this latter from suitable plastic material, for example, and usually project to a slight extent from the surface of the annular zone 17*b*. Said tongues are capable of downward withdrawal and introduction into corresponding recesses 22 when they are subjected to a downward thrust. Under these conditions, when the lugs 19 are engaged within the slots 14, the annular member 11 rests on the resilient tongues 21 which are capable of withdrawing into the recesses 22 while applying the annular member 1 and the ring 17 against each other with sufficient force. Once this withdrawal has been completed, the ring 17 can be pivotally displaced on the stepped projections 16 until the lugs 19 have engaged within the recesses 15 by snap action. In this position, when the pressure on the ring 17 is released, the tongues 21 return upwards and apply a resilient force on the annular member 11, thus tending to maintain said member in rigidly fixed relation to the ring 17.

The practical application of the safety turnstile described in the foregoing can readily be understood and is as follows.

Figure 4:
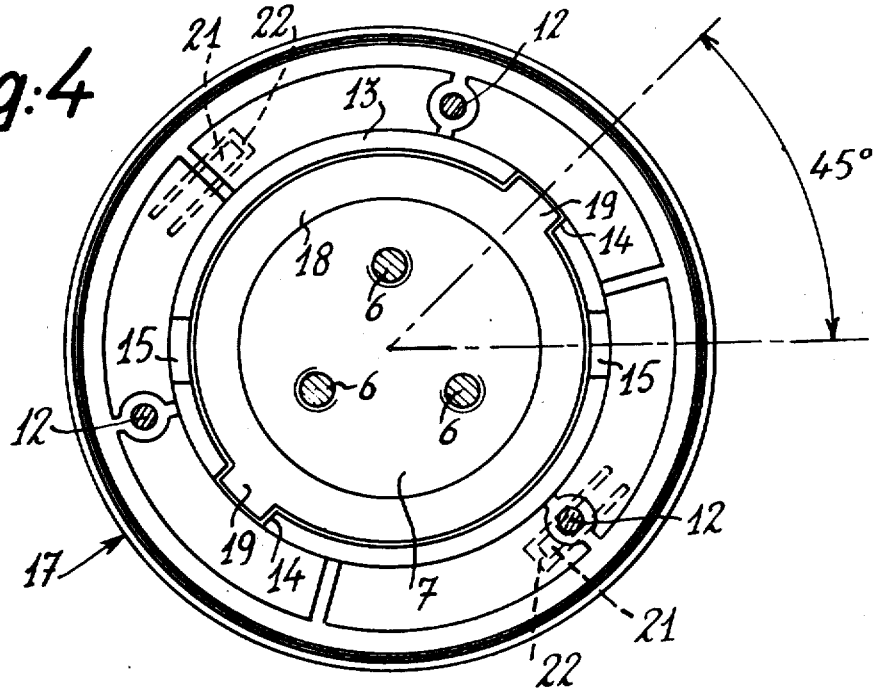
FIG. 4 is a transverse sectional view taken along line IV—IV of FIG. 2 and showing the ring in its disengaged position with respect to the annular member.
Figure 5:
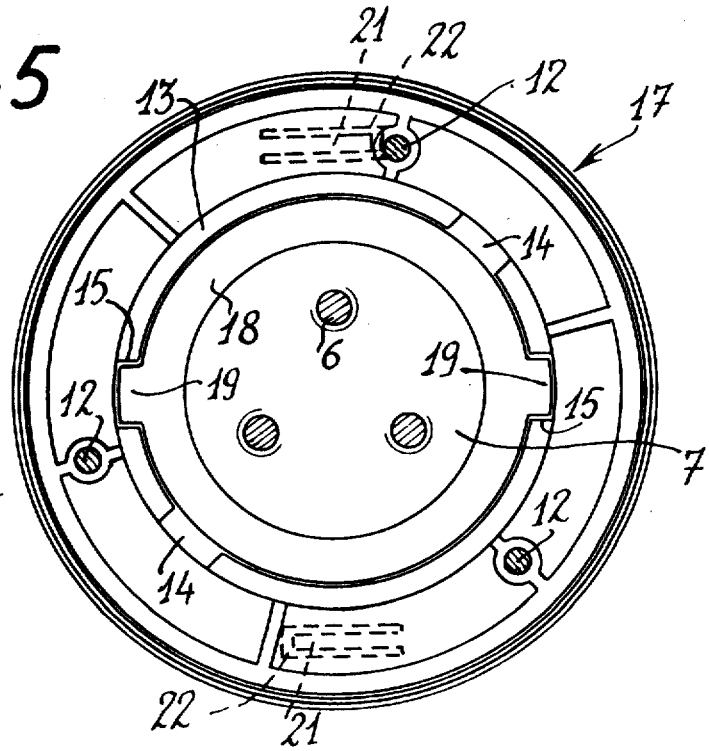
FIG. 5 is a transverse sectional view which is similar to FIG. 4 and shows the ring in its engaged position with the annular member.

The ring 17 is engaged over the post 3, whereupon the central pivot 5 is secured to the post by means of screws 6. The rotary head 1 fitted with the annular member 11 is then placed on the central pivot 5. The lugs 19 of the ring 17 are engaged within the slots 14. As soon as said lugs reach a position of abutment against the annular shoulder 9*a*, the ring 17 is displaced in pivotal motion in order to cause the lugs 19 to slide over the stepped projections 16 and then to cause them to engage within the recesses 15 after a movement of rotation through an angle of 45 degrees. The engagement of the lugs 19 within the slots 14 is illustrated in FIG. 4 whilst their snap-action engagement within the recesses 15 is shown in FIG. 5. In this second position, the ring 17 is released and the tongues 21 which had up to that moment been withdrawn within their recesses 22 are restored elastically to their raised positions, thus exerting on the annular member 11 an upwardly directed force which maintains the ring 17 locked on the annular member 11 by bearing against the underface of said member. The ring 17 is therefore rigidly fixed to the rotary head 1 which cannot be detached from the turnstile post 3 without a special unlocking operation.

In order to carry out said unlocking operation, it is only necessary to exert an upward vertical thrust on the ring 17.

Said upward thrust releases the lugs 19 from the recesses 15, whereupon the ring 17 is rotated through an angle of 45 degrees until the lugs 19 come into position within the slots 14. At this moment, the ring 17 is released from the annular member 11, with the result that the head 1 can be removed from the turnstile post 3. This movement of rotation is indicated by arrows 23 on the outer face of the ring 17 (as shown in FIG. 6).

Under these conditions, the rotary head 1 can be very easily and rapidly separated from the post 3 by means of a simple vertical thrust followed by a rotation through an angle of 45 degrees. In the event of panic conditions, this feature constitutes an appreciable advantage in premises such as a store or building having an entrance which is controlled by the turnstile in accordance with the invention since it facilitates the evacuation of such premises.

The invention is not limited to the form of construction hereinabove described and may accordingly extend to alternative forms of construction. The number of lugs 19, slots 14 and recesses 15 could thus be greater than two. By way of example, it would accordingly be possible to employ three lugs, slots and recesses disposed at angular intervals of 120 degrees. Similarly, provision can be made for more than two resilient tongues 21 or else these latter can be replaced by any other equivalent snap-action engagement means. Finally, although the annular member 11 is preferably made of plastic material and added to the base of the rotary head 1 as described earlier, said annular member could be replaced by internal machining of the inner face of the base of the rotary head 1. In actual prove both difficult and costly.

What is claimed is :

1. A safety turnstile to be installed at the entrance of a store, of a stadium, or of any other location for guiding the influx of visitors, comprising a head to which arms are attached and which is rotatably mounted on a pivot placed on the top end of a supporting post, as well as a ring which can be removably attached to the base of the rotary head and around the top end of the supporting post in order to maintain the head on the pivot, said pivot being disposed in a projecting and overhung position above the top of said post, wherein an annular member is fixed or arranged beneath the base of said rotary head in such a manner as to provide an annular passage between on the one hand the top of the post and on the other hand the annular member and the base of the head, provision being made in said annular member for slots in which corresponding projecting lugs of the ring are capable of resilient snap-action engagement, with the result that said ring is capable of taking up two angular positions within said angular member, namely a first position in which the ring is disengaged from the annular member and consequently from the rotary head which can be detached from the turnstile post and a second position in which the ring is rigidly fixed to the annular member and retains the rotary head on said pivot and said post, said two positions being separated by a predetermined angular interval.

2. A turnstile according to claim 1, wherein the ring is provided with a projecting internal annular collar which is coaxial with the turnstile post and can be introduced within the annular passage between the rotary head and the post, said annular collar being provided with at least two lugs adapted to engage within two associated slots formed in the annular member, at least two recesses being formed in said annular collar at predetermined angular intervals such as 45 degrees with respect to the corresponding slots in order to receive the lugs of the ring after a corresponding rotation of said ring, resilient snap-action engagement means being provided for locking the lugs within the recesses and subsequently for coupling said ring with said annular member and said rotary head in interlocked relation.

3. A turnstile according to claim 2, wherein the slots aforesaid extend to the full height of an annular collar whose diameter exceeds the diameter of the annular collar of the ring in order to permit free introduction of the lugs aforesaid within said slots whilst the lug-retaining recesses are formed only in the upper portion of the annular collar and are separated from the slots by intercalary stepped projections, resilient members being arranged on said ring around said annular collar in order to exert a resilient thrust on the ring with the result that a pressure must first be exerted by the ring on the annular member in order to move the lugs from the slots into the recesses and in order to overcome the oppositely-acting thrust of said resilient members, whereupon the ring can be displaced in pivotal motion with respect to the annular member by causing the lugs to slide over the stepped projections, the lugs being then engaged within the recesses by resilient snap-action and are resiliently maintained within said recesses by means of the retaining members, said ring being then locked in the annular member and the turnstile head being consequently maintained in the second position aforesaid.

4. A turnstile according to claim 3, wherein the retaining members are constituted by at least two resilient tongues secured to the ring and capable of engaging within recesses of said ring under the thrust exerted by said ring on said annular member.

* * * * *